United States Patent [19]

Martin

[11] Patent Number: 4,787,517

[45] **Date of Patent: * Nov. 29, 1988**

[54] EASILY OPENED AND RECLOSABLE BAG WITH TEAR-GUIDING RIDGES

[76] Inventor: Andrew McG. Martin, Boston, Mass.

[ * ] Notice: The portion of the term of this patent subsequent to Oct. 29, 2002 has been disclaimed.

[21] Appl. No.: 926,389

[22] Filed: Nov. 4, 1986

Related U.S. Application Data

[63] Continuation of Ser. No. 732,046, May 6, 1985, abandoned, and a continuation of Ser. No. 451,170, Nov. 29, 1982, Pat. No. 4,549,657, which is a continuation-in-part of Ser. No. 251,185, Apr. 6, 1981, abandoned, which is a continuation-in-part of Ser. No. 11,080, Feb. 12, 1979, abandoned, and a continuation-in-part of Ser. No. 29,886, Apr. 13, 1979, abandoned.

[51] Int. Cl.[4] ..... B65D 27/36

[52] U.S. Cl. ..... 206/610; 206/621; 383/35; 383/62; 383/77

[58] Field of Search ..... 206/603–606, 206/608, 610, 613, 620, 621, 629, 632–634; 383/35, 40, 61, 62, 77, 86, 89, 94

[56] References Cited

U.S. PATENT DOCUMENTS

| | | | |
|---|---|---|---|
| 3,217,971 | 11/1965 | Shvetz | 206/629 X |
| 3,323,707 | 6/1967 | King | 206/604 |
| 3,397,835 | 8/1968 | Henning | 206/610 |
| 3,510,054 | 5/1970 | Sannl et al. | 206/610 |
| 3,974,958 | 8/1976 | Ruda | 383/119 X |
| 4,549,657 | 10/1985 | Martin | 206/610 |

FOREIGN PATENT DOCUMENTS

| | | | |
|---|---|---|---|
| 0109965 | 6/1984 | European Pat. Off. | 206/610 |
| 1488310 | 6/1967 | France | 206/632 |
| 303252 | 8/1968 | Sweden | 206/632 |

*Primary Examiner*—Stephen Marcus
*Assistant Examiner*—Bryon Gehman
*Attorney, Agent, or Firm*—Nutter, McClennen & Fish

[57] ABSTRACT

An easily opened and reclosable bag for packaging snacks or the like includes an unsealed area that facilitates opening the bag and another integral bag portion reinforced with a seal ridge that can be torn away from the body of the bag without penetrating the bag to provide a reclosure tie.

29 Claims, 11 Drawing Sheets

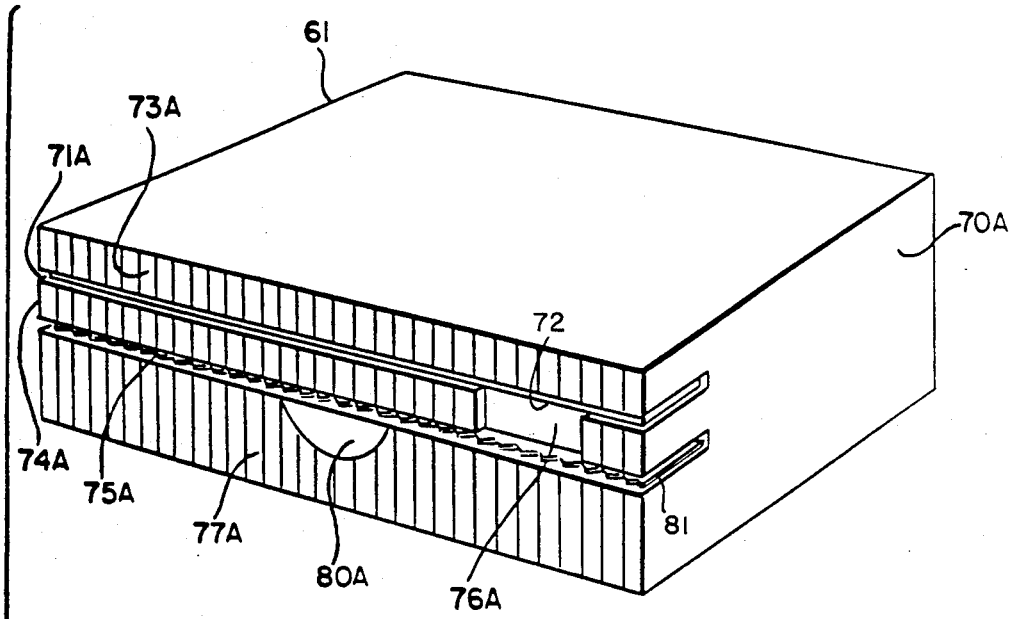
Fig. 6
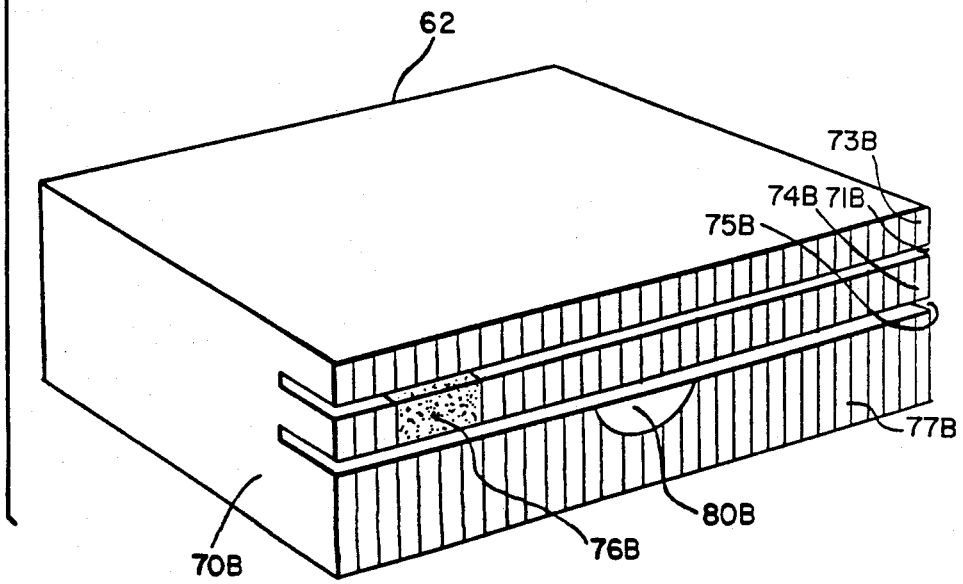

Fig. 7
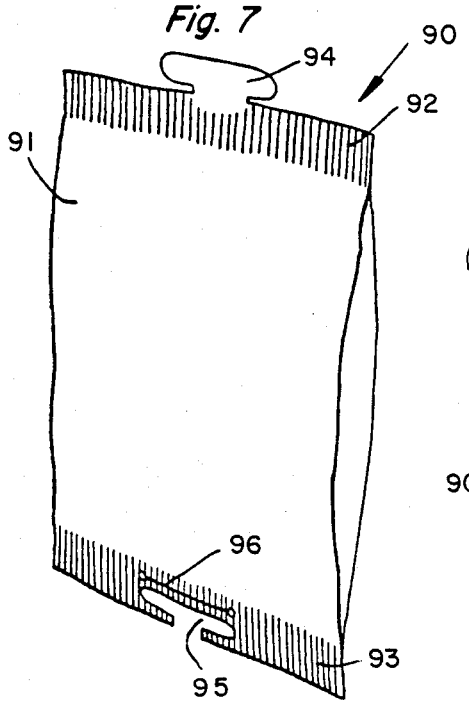
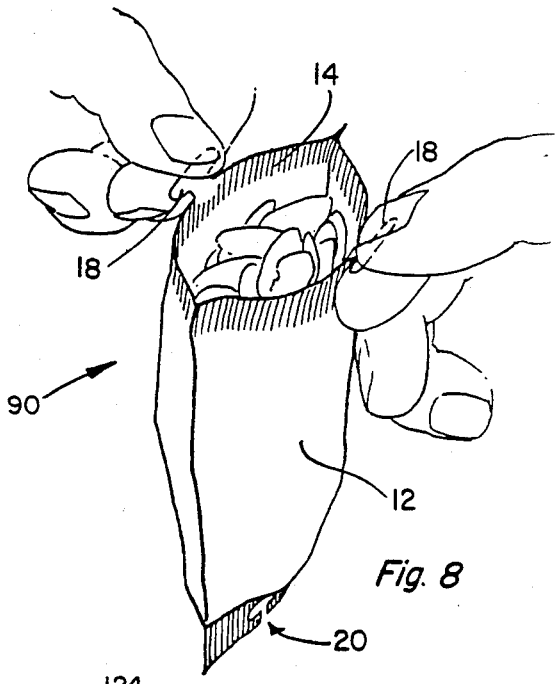
Fig. 8
Fig. 9
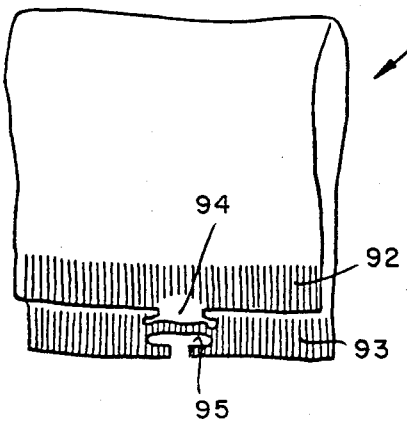
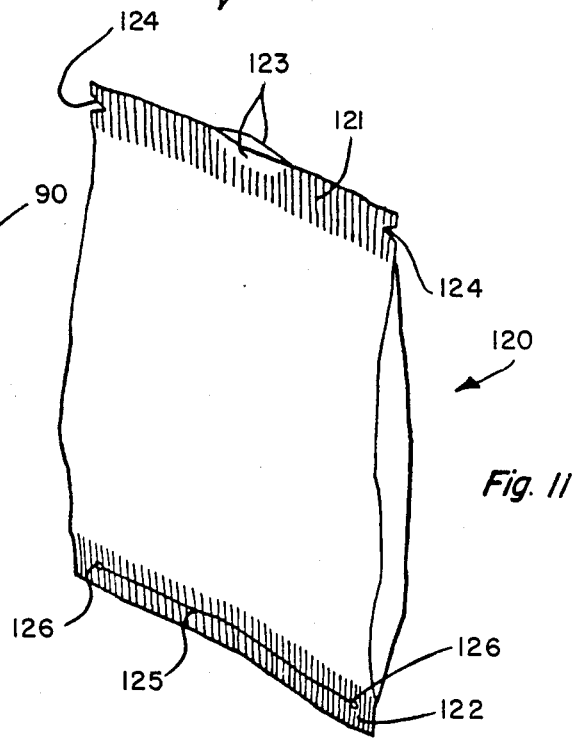
Fig. 11

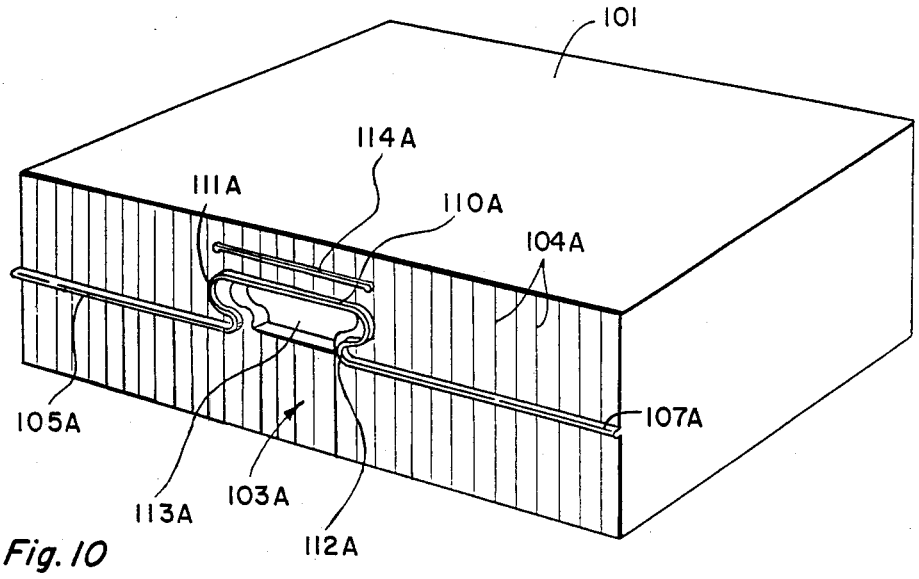
Fig. 10
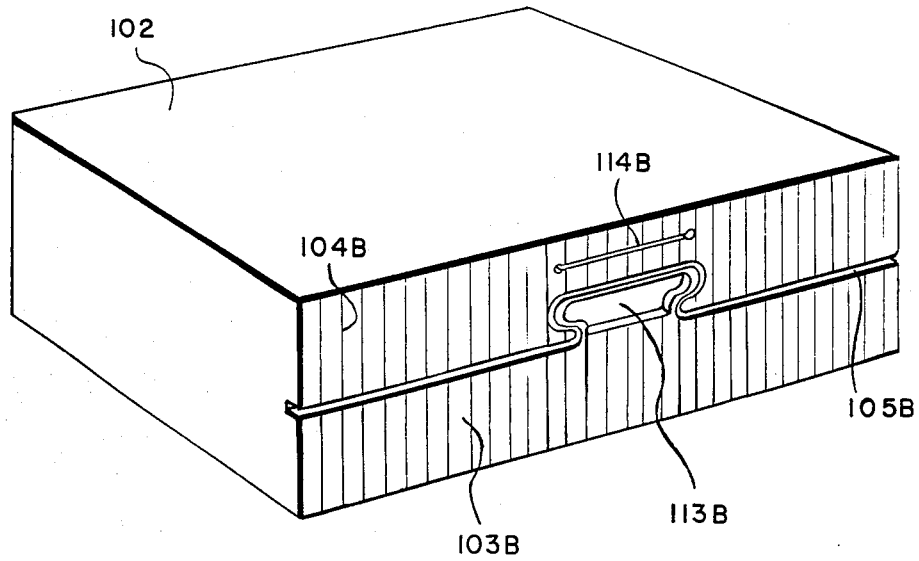

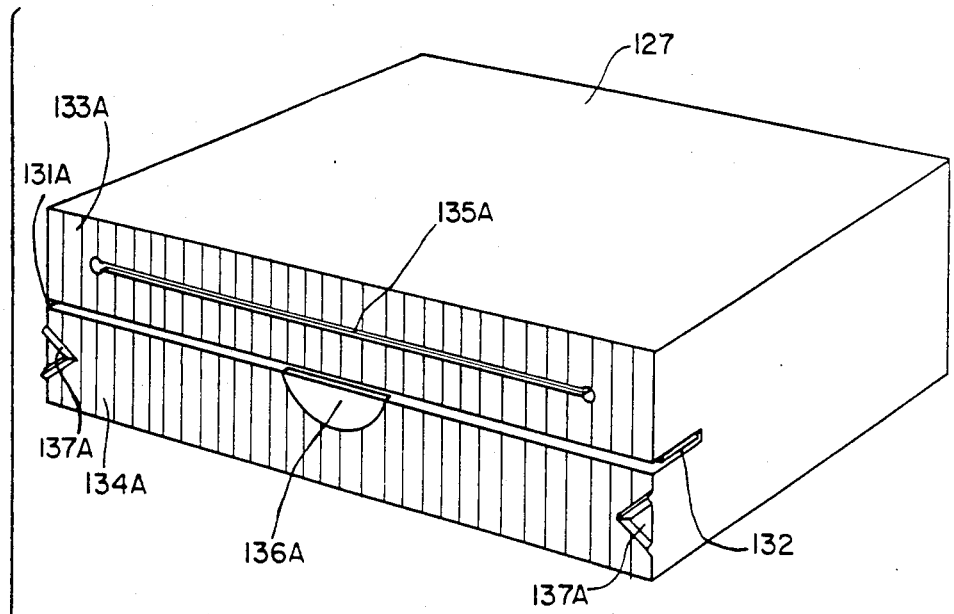
Fig. 12
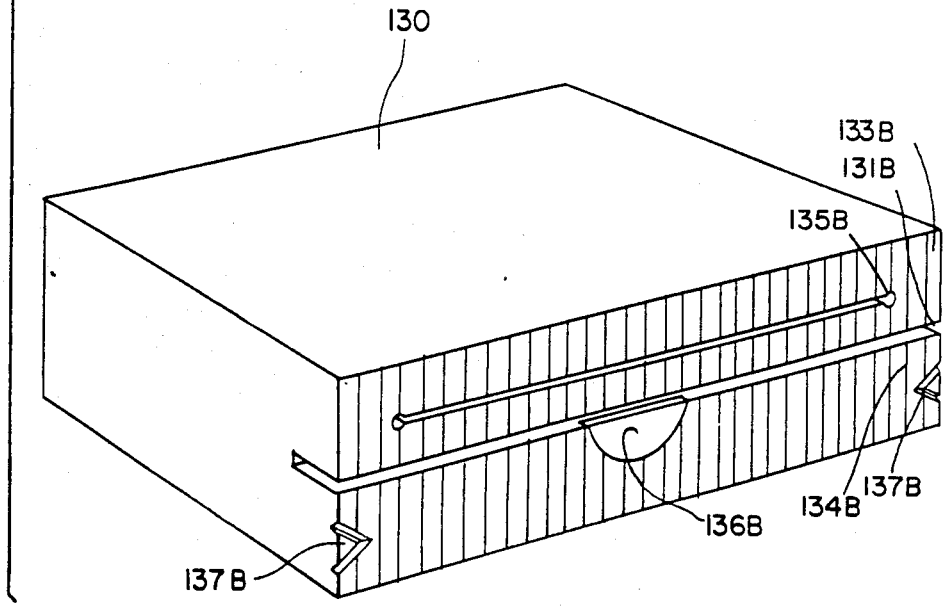

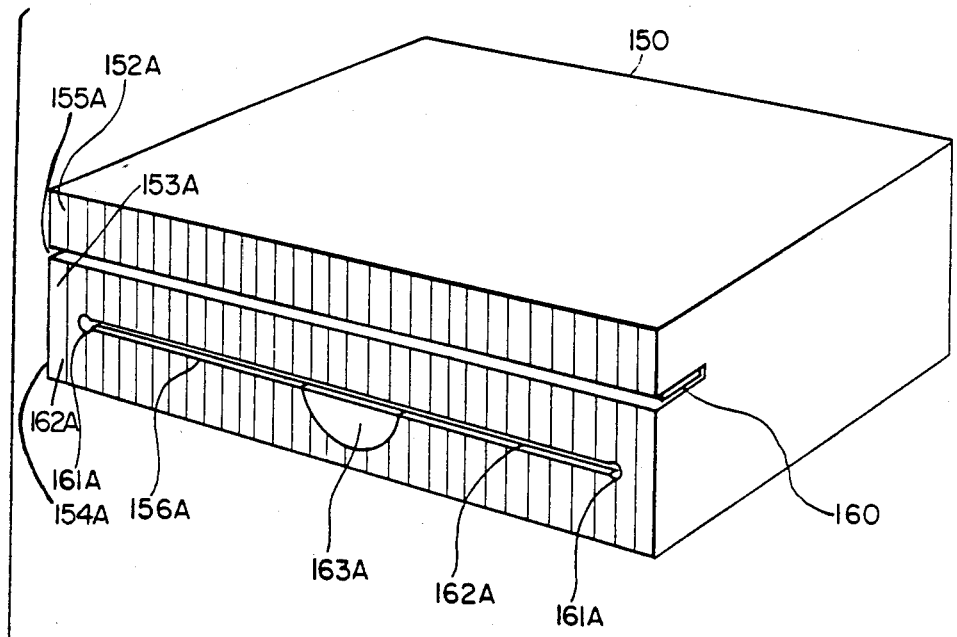
Fig. 16
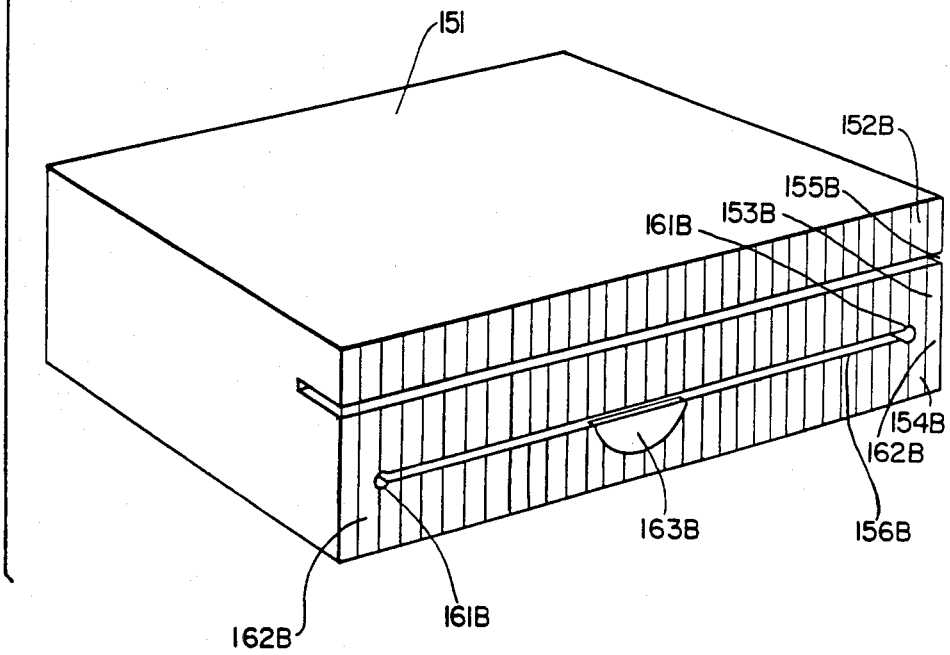

EASILY OPENED AND RECLOSABLE BAG WITH TEAR-GUIDING RIDGES

CROSS REFERENCE TO RELATED APPLICATIONS

This is a continuation of application Ser. No. 732,046 filed May 9, 1985 now abandoned. This application is also a continuation of U.S. patent application Ser. No. 451,170, filed Nov. 29, 1982, now U.S. Pat. No. 4,549,657, which is a continuation-in-part of application Ser. No. 251,185, filed Apr. 6, 1981, which is a continuation-in-part of U.S. patent application Ser. No. 11,080, filed Feb. 12, 1979, by Andrew McG. Martin for a Bag with Improved Reclosure and also of U.S. patent application Ser. No. 29,886, filed Apr. 13, 1979, by Andrew McG. Martin for an Improved Sealing Apparatus. The last three related applications identified above are now abandoned.

BACKGROUND OF THE INVENTION

This invention generally relates to the construction and manufacture of bags and more specifically to a bag structure that facilitates opening and reclosing of a bag and the apparatus for manufacturing such a bag.

Bags are used for storing a wide variety of contents and are composed diverse materials. Although this invention can be utilized and applied to many different bags, it is particularly suited for bags that are used for packaging snack foods and the like and that are composed of thin cellophane or organic polymer base material that has limited tear resistance.

Hundreds of millions of these bags are manufactured each year. They are manufactured in a combined form-and-fill apparatus. More specifically, in such apparatus sheet material is drawn past a guide which directs the material into a tubular form surrounding a mandrel. As the material is drawn along the mandrel, an overlapping seam is formed in the material sealed by a heat or pressure sealing process. The material is thus formed into a tube as it passes over the mandrel. The material then passes heat sealing jaws that are disposed to form a transverse heat seal across the tube thereby to simultaneously "form" an upper seal in one bag and a bottom seal on an adjacent bag. When this occurs, the contents can "fill" the bag through a passage in the mandrel. The resulting bag then contains a longitudinal seal along the material seam and seals at the ends that define an hermetically sealed pouch for the contents. The sealing jaws normally also contain a mechanism for severing the completely sealed bag for subsequent shipment. This "form-and-fill" manufacturing process is widely accepted because it is reasonably simple, requires a minimal number of operations, and is reliable.

However, bags formed by this process are not without their problems as purchasers of snack or like contents of such bags are well aware. The bags can be difficult to open and do not facilitate reclosure if the contents are only partially consumed. Typically a purchaser will attempt to open the bag either by tearing through the seal or by trying to separate the seal. When an attempt is made to tear through the seal, the tear detection and length are random. The nature of the material is such that the tear could travel in any direction and depending on the force utilized to start the tear could travel for various distances. If the purchaser grabs the oppositely spaced walls of the pouch and then tries to pull the walls apart to separate the seal, a random opening also can occur. Specifically the force required to separate that seal varies widely and is not predictable. In either case, the opening procedure is not controlled or predictable. As a result, the bag oftentimes tears and is thus destroyed. Moreover, whether the bag tears or not, the operation often causes the contents to spill.

Generally these bags contain perishable contents or contents that become stale if exposed to air. If the contents of such bags are only partially consumed, it is not easy to reclose the bags thereby to preserve the freshness of the remaining contents. The open end of the bag, assuming it remains intact during the opening procedure or opening operation, can be rolled up; however, at rest the bag tends to resume its original shape and the rolled portion straightens thereby opening the bag and exposing the contents to air. Thus it is difficult to reclose the bag without some separate element.

A great deal of research and development has been expended in order to provide a bag which is easy to open and which can be simply reclosed. A number of solutions have been proposed.

Some bags have been designed in an attempt to solve both the opening and reclosing problems. Generally these bags include some structure for assisting or directing the tear and some separate, removable element that can be used to reclose the bag if the contents are only partially consumed. For example, U.S. Pat. No. 3,184,149 discloses a resealable bag. This bag includes a sheet of flexible material having a structure for cutting through the side of the bag to expose the contents for consumption or use. If the contents are only partially utilized, a protective layer formed in a top seal portion is removed to expose a coextensive area of adhesive material. When the top of the bag is folded down against itself, the adhesive material adheres to the bottom seal to close the bag. U.S. Pat. No. 3,224,640 discloses a bag having at least three walls. The contents are stored in a pouch between the first and second walls. The bag includes a tear line partially through the seal. As the top is torn off the bag, the contents are exposed. A slit is formed in the third wall to receive the top of the bag after it is folded over. U.S. Pat. No. 3,618,850 discloses a bag in which a pleated foil strip is affixed to the bag just below one of the end seals. The bag is opened by tearing through the seal. The foil serves as a tear stop and guides the tear transversely across the bag. If the contents are only partially consumed, the top of the bag can be folded about a transverse axis that passes through the foil. The pleats in the foil tend to retain the folded shape of the foil and thereby keep the bag closed.

Another group of bag designs are characterized by a tear strip that can also be used to reclose the bag. U.S. Pat. Nos. 3,311,288 and 3,426,959 disclose such bags. More specifically, a tear strip is affixed transversely across the bag into one wall in the area of the pouch. When the tear strip is pulled, it rips the bag under the tear strip and exposes the contents. Once the tear strip has been removed, it can be saved to reclose the bag by being wrapped around the bag. U.S. Pat. No. 3,480,198 discloses a bag in which a tear line is formed across the bag in one or both of the walls of the pouch inwardly of the heat seal; that is, in the walls that are separated to form the pouch. The tear line is formed by apertures through both side walls that are fused around their circumferences so that the seal is not broken until the bag is torn along the tear line. The resulting top can then be removed to form a tie for the remaining contents of the bag. However, this action does not open the bag completely.

U.S. Pat. No. 3,613,874 discloses a bag in which a pressure sensitive adhesive is applied as in U.S. Pat. No. 3,184,149. A tear strip is also provided to tear away a portion of the bag; it has a fairly high tensile strength and is bonded to the film forming the bag rather strongly in such a way that the strip will not break or pull away from the film but will overcome the film's tear strength when it is pulled thereby tearing the bag. U.S. Pat. No. 3,619,395 also discloses a plastic bag with a tear strip in the form of a ribbon which is pulled to tear the bag. This bag contains a releasable fastening means on the inner, opposed wall surfaces which enables the bag to be resealed.

The individual problem of facilitating the opening of these bags has also been the subject of research and development. Another general approach can be characterized as providing tabs above the seal or outside the seal for facilitating the opening. These approaches are exemplified in U.S. Pat. Nos. 3,397,835 and 3,419,137, and British Pat. No. 620,354. In U.S. Pat. No. 3,397,835, for example, a corner portion, or inset, is heat sealed and includes a tear line. When the bag is opened, the portion outside the tear line is removed; then the opposite walls of the bag in the inset, which are not sealed together, can be grasped individually to facilitate opening of the bag. Another approach has been to add structure to a bag that will limit or direct the tear tearing during opening. Folding the bag material to produce folded portions around the bag are shown in U.S. Pat. No. 2,053,116. The use of transverse beads to limit the tear is shown in U.S. Pat. Nos. 3,323,707 and 4,139,643. Other examples are shown in U.S. Pat. Nos. 3,412,918 and 3,179,327. The use of special chemical treatments by placing a coating between the heat sealable surfaces before bonding to facilitate opening is shown in U.S. Pat. No. 3,511,436.

A concept for facilitating the closure of paper bags is disclosed in U.S. Pat. No. 2,023,855. Tabs are formed in one wall of the bag. This wall extends beyond the other wall and slits are formed in the other wall. On closure the extended wall is folded over the other and the tabs are then inserted through the slits; other corresponding or analogous closures are also shown.

These various prior bag configurations have not gained wide, if any, commercial acceptance. They are all characterized by being more expensive to manufacture than a conventional bag. This added expense has not justified the acceptance of these configurations by the manufacturers of the contents that fill the bag. There are several reasons for this added expense. Many of the bags require the addition of discrete elements such as tear strips, or releasing agents. Others require special manufacturing apparatus or processes to provide multiple seals, to insert separate elements, to fold or configure the bags. Still others require an increase in the amount of bag material that is utilized to form the bag. Because of these and other reasons the industry, particularly the snack food industry, continues to package contents in a tubular bag with a longitudinal seal and two plain end seals and without any means for facilitating the opening or the reclosing of the bag.

SUMMARY OF INVENTION

Therefore, it is an object of this invention to provide a bag that is easy to open and to reclose.

Another object of this invention is to provide an easily opened, reclosable bag that can be constructed without the addition of discrete elements to the bag.

Yet another object of this invention is to provide an easily opened, reclosable bag that can be made without special manufacturing procedures and that can be easily integrated into a manufacturing process.

Still another object of this invention is to provide an easily opened, reclosable bag that can be made without any significant increase in the amount of material in the bag.

Still yet another object of this invention is to provide an easily opened, reclosable bag that can be manufactured without any significant increase in expenses for materials or processing.

Still yet another object of this invention is to provide apparatus that adapts a conventional production facility for forming and filling bags to produce easily opened and reclosable bags.

Still yet another object of this invention is to provide apparatus for adapting conventional production of filled bags to provide an easily opened, reclosable bag without introducing any significant added expense to the manufacturing apparatus.

Still yet another object of this invention is to provide apparatus for converting a facility for producing filled sealed bags to produce easily opened, reclosable bags without requiring any significant modification to the conventional manufacturing apparatus.

In accordance with one aspect of this invention, a bag is formed to enclose the contents in a pouch between the walls of the bag and at least two seals formed by the material of the bag. The easy opening and reclosing feature is provided by forming an unsealed portion at one seal; this exposes separated wall portions adjacent the seal and facilitates the gripping of the separated wall portions for breaking the seal to enable access to the contents. The bag then is easily reclosed by a reclosure element that is formed integrally with the bag in at least one of the seals so that the open end of the bag can be reclosed after the seal has been broken.

A conventional apparatus for forming and filling bags of this type includes heat sealing jaws that simultaneously form sealed portions in adjacent bags. In accordance with another aspect of this invention, the conventional apparatus is modified by installing new jaws. These jaws simultaneously form the unsealed portion in one seal, the reclosure means in at least one of the seals and a sever line for separating adjacent filled bags.

This invention is pointed out with particularity in the appended claims. The above and further objects and advantages of this invention may be attained by referring to the following description taken in conjunction with the accompanying drawings.

BRIEF DESCRIPTION OF THE DRAWINGS

FIG. 6 depicts heat sealing jaws used in the apparatus of FIG. 5 for providing the bag shown in FIG. 1;

FIG. 7 is a perspective view of a second embodiment of a bag constructed in accordance with this invention;

FIG. 8 is a perspective view that illustrates the ease with which the bag in FIG. 7 is opened;

FIG. 9 is a perspective view that illustrates the ease with which the bag in FIG. 7 is reclosed;

FIG. 10 depicts heat sealing jaws that are utilized in the apparatus of FIG. 5 to construct the bag in FIG. 7;

FIG. 11 is a perspective view of a third embodiment of a bag constructed in accordance with this invention;

FIG. 12 depicts heat sealing jaws for constructing the bag shown in FIG. 11 with the apparatus of FIG. 5;

FIG. 16 depicts the heat sealing jaws for constructing the bag shown in FIG. 13;

DESCRIPTION OF ILLUSTRATIVE EMBODIMENTS

Embodiment 1

Figure 1:
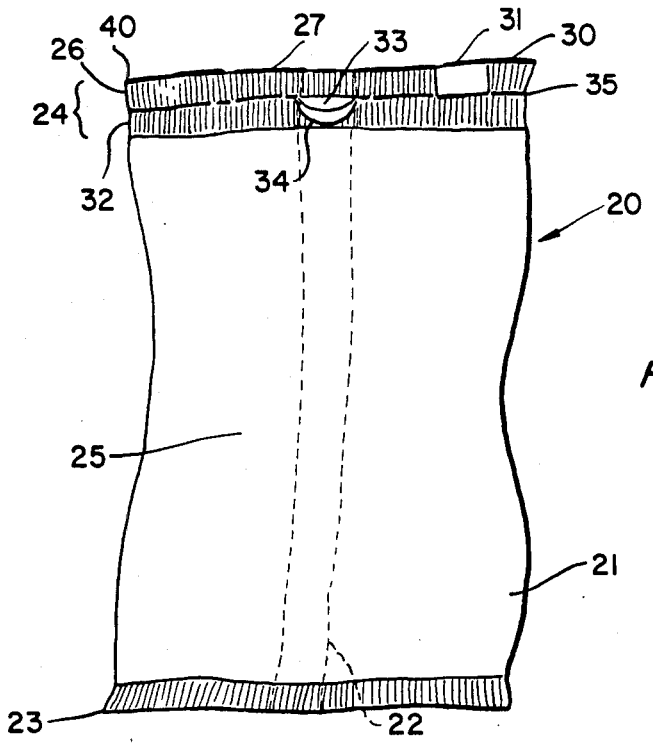
FIG. 1 is a perspective view of one embodiment of a bag constructed in accordance with this invention.

FIG. 1 depicts a bag 20 that is adapted for storing snack foods as the contents and that is constructed in accordance with a preferred form of this invention. The bag 20 is formed of a heat sealable, treated cellophane 21 or other thin organic polymer based materials. The bag 20 is formed as a tube by forming the material 21 into a cylinder and heat sealing an overlapping portion to form a longitudinal heat seal 22 that is shown in phantom. A second heat seal 23 traverses the bag 20 across the bottom thereby to close the bag at that end. A third heat seal 24, at the other end, or top, of the bag 20 provides the remaining seal and, with the end seal 23, defines a sealed pouch 25 in the bag 20.

In this particular embodiment all the structure for achieving the various objects and advantages of this invention is found in the heat seal 24. This heat seal 24 has two transverse portions. The outer transverse portion constitutes a reclosure tie 26; it has two spaced heat sealed areas 27 and 30 separated by an unsealed area 31. The reclosure tie 26 is contiguous with another heat sealed portion 32 that also extends across the width of the bag and that is formed of opposite walls of the material 21.

At the center of the heat seal 32, an outer semicircular area 33 is not sealed. This area is laterally offset from the unsealed area 31. A sealed area 34 between the unsealed area 33 and the pouch 25 maintains the integrity of the overall sealing structure. The reclosure tie 26 and seal 32 are formed integrally with the bag and are separated along a tear line 35 constituted by alternate perforations and indentations or another form of weakened line.

Figure 2:
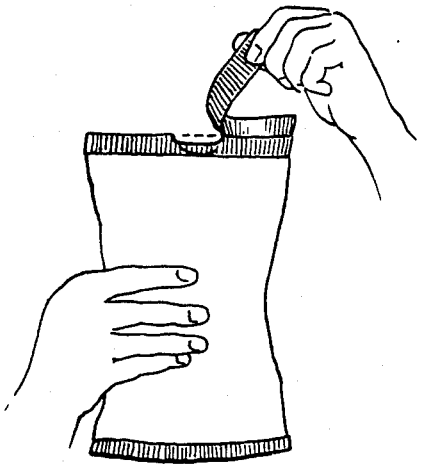
FIG. 2 is a perspective view of the bag in FIG. 1 that illustrates the easy opening feature of the bag.

The ease with which this bag is opened can now be seen by referring to FIGS. 1 and 2, where the bottom seal 23 is shown for orientation. First the user tears the reclosure tie 26 from the bag 20 along the tear line 35. When the reclosure tie 26 is removed, the unsealed area 33 in the seal 32 is exposed. However, the removal of the reclosure tie 26 does not destroy the sealed pouch because the area 34 is still intact. It should also be noted that the reclosure tie 26, while in place, prevents accidental opening of the bag by blocking access to the unsealed portion 33.

When the unsealed area 33 is exposed, the opposite sides of the wall define separated tabs 36 and 37 which the user grabs in his two hands and pulls apart; this separates the walls forming the seal 32 and exposes the contents of the bag. No tearing of the bag material is required, and the tabs 36 and 37 allow a reasonably controlled separation of the seal 32 so that risks of spillage and bag damage are minimized during the opening of the bag 20.

Figure 3:
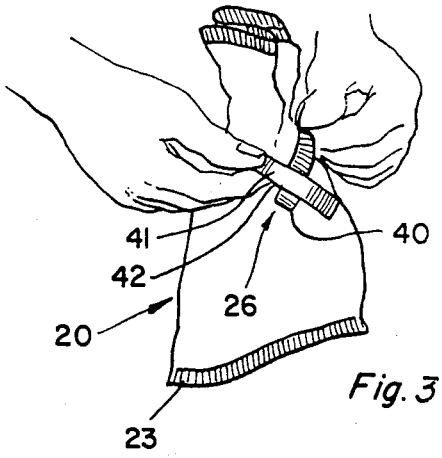
FIG. 3 depicts the bag in FIG. 1 after it has been opened to illustrate one approach for reclosing the bag.
Figure 4:
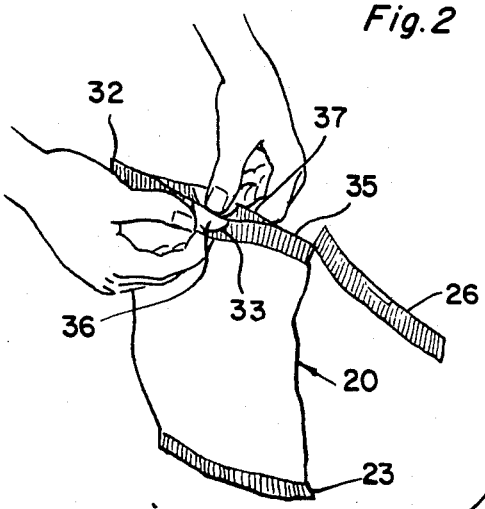
FIG. 4 is a perspective view of the bag in FIG. 1 after it has been reclosed.
Figure 4:
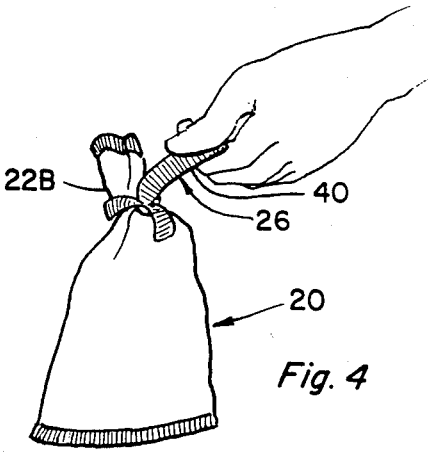

The ease with which the reclosure is achieved can be seen by referring to FIGS. 1, 3, and 4. When only part of the contents have been consumed, the user gathers the top portion of the bag 20, as shown in FIGS. 3 and 4, and then uses the reclosure tie 26. Specifically, the user slips an end 40, that is opposite the sealed area 30, through opposite walls 41 and 42 that form the unsealed area 31. This defines a loop in the reclosure tie 26 that is placed around the gathered portion of the bag 20. The end 40 then can be pulled through the unsealed area 31 to close the loop tightly around the bag 20. The end 40 then becomes a handle. The friction between the wall portions 41 and 42 and the portion of the reclosure tie 26 extending therethrough is sufficient to lock the tie 26 and keep the bag 20 closed.

Alternatively, a user could gather the top of the bag 20 and wrap the reclosure tie 26 around the bag; the tie 26 could then be fixed merely by tying an overhand or other type of knot in the reclosure tie 26.

Referring again to FIG. 1, this bag 20 is easily opened and reclosed and achieves all the objects of this invention. Specifically the reclosure tie 26 is formed integrally with the bag and of the same material, during the same manufacturing process. The unsealed area 33 is formed integrally with the bag 20. There are no discrete elements associated with the bag 20. The heat seal 24 can also be formed with a longitudinal dimension which corresponds to the existing heat seal dimensions in conventional bags, thereby eliminating any additional bag material. Thus, the cost of the bag shown in FIG. 1 should not be significantly different than that of a conventional bag which has neither the easy opening nor reclosure feature of the bag 20. Moreover the bag shown in FIG. 1 is adapted for production in a conventional "form-and-fill" process without any significant modification to the manufacturing apparatus.

Figure 5:
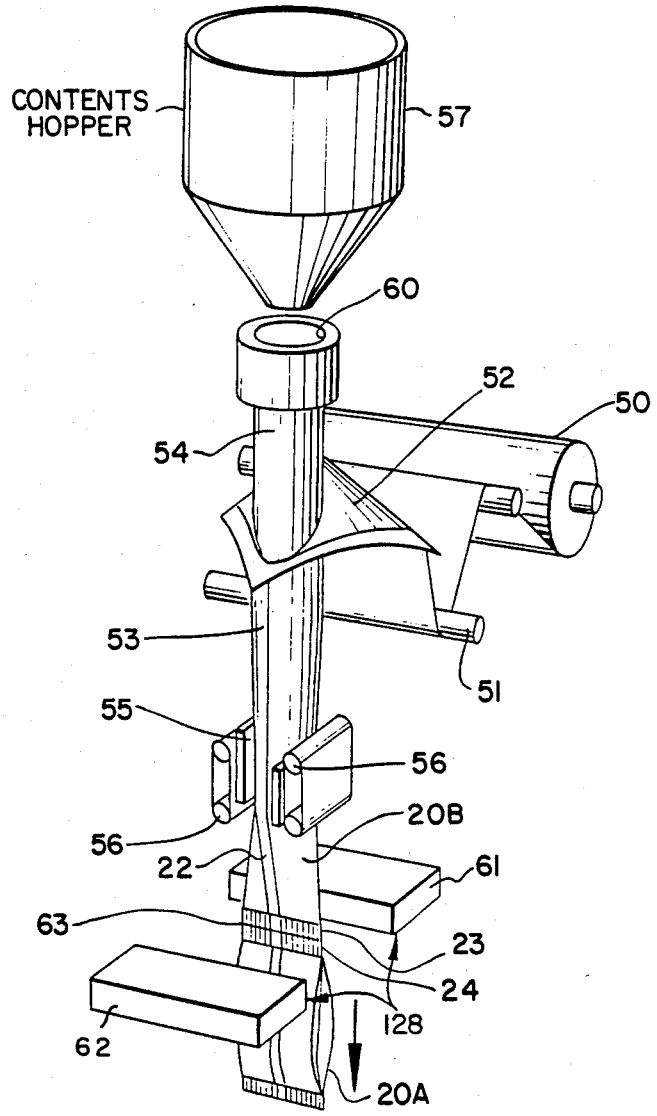
FIG. 5 is a perspective view, in schematic form, of typical apparatus for automatically forming and filling the bags which apparatus is of the type that is useful in manufacturing bags in accordance with this invention.

The apparatus depicted in FIG. 5 is typical of the bag making apparatus known to the art. In this apparatus, a roll of heat sealable packaging film 50 is carried past a guide roller 51 to a panning shoulder 52 that forms the film 50 into a folded, double thickness, vertically moving web 53 about a cylindrical mandrel 54. A heat seal bar 55 coacts with rollers 56 to insure formation of the longitudinal seal 22 shown in FIG. 1. As the bags pass by the lower termination of the cylinder 54, a measured amount of contents from a hopper 57 is dispensed through a cylindrical passage 60 in the mandrel 54; the contents then fall into a pouch that has been formed above the bottom seal 23 by heat sealing jaws 61 and 62, that are shown only in diagramatic form.

More specifically, as a filled bag is drawn to the position shown by bag 20A, the sealing jaws are brought together to form the upper seal 24 in the bag 20A and the lower seal 23 in the next bag 20B to be filled. In addition the bags are perforated or cut along a line 63 that constitutes a bag separation line.

As will now be shown, it is merely necessary to substitute new sealing jaws 61 and 62 in conventional apparatus. The controls and actuating mechanisms that are involved with the conventional heat sealing jaws remain substantially unchanged.

A set of heated sealing jaws for forming a bag shown in FIG. 1 is depicted in FIG. 6 and is designated generally by reference symbols 61 and 62. They are complementary or mating jaws. Thus the like reference numerals are applied to corresponding elements in the two mating jaws with the suffix "A" designating an element in jaw 61 and the suffix "B" designating an element in jaw 62.

Each of the jaws is formed in a block of material 70A and 70B. There are upper transverse slots 71A and 71B in the blocks that correspond to the top edge of the bag shown in FIG. 1 and the cutting line 63 shown in FIG. 5. A cutting blade 72 is positioned in the slot 71A and is activated by a conventional mechanism through access ports in the block 61. More specifically, at an appropriate time the blade 72 is forced outwardly from the slot 71A into the slot 71B, thereby to sever a filled and sealed bag from the next bag to be filled and sealed.

The slots 71A and 71B also define a line of demarcation for upper, corrugated faces 73A and 73B. When the jaws 61 and 62 are brought together, the faces 73A and 73B heat the material between them and form the corrugated heat seal 23 at the bottom of the bag 20 in FIG. 1. Sealing faces 74A and 74B lie between slots 71A and 75A and slots 71B and 75B, respectively. The faces 74A and 74B are corrugated except at rectangular areas 76A and 76B. These areas are either constituted by recesses in the faces 74A and 74B or by recesses that are filled with a heat insulating material, so they do not heat or seal the corresponding area of bag material. Thus, the faces 74A and 74B form the reclosure tie 26 in FIG. 1.

Another corrugated surface 77A extends across the jaw 61 below the slot 75A. A semicircular area 80A is formed in the surface 77A contiguous with the slot 75A, but it does not extend across the entire surface 77A in the vertical direction as shown in FIG. 6. Thus, the surface 77A forms a corrugated surface across the entire width of the jaw 61. The corresponding surface 77B and area 80B are contained in the jaw 62. Thus, as the jaws 61 and 62 are brought together, these surfaces coact to form the sealed area 32 with the area 33 between the areas 80A and 80B not being heated or sealed.

The slot 75A contains a perforating punch or blade 81. When the jaws 61 and 62 close, a drive mechanism, which can be the same drive mechanism that drives the blade 72, forces the perforation blade 81 or like mechanism from the jaw 61 toward and partially into the slot 75B. A blade 81 partially perforates the sealed portion 24 to provide the tear line 35.

As will now be apparent, the mechanisms for moving the heated sealing jaws 61 and 62 and the blades 72 and 81 in FIG. 6 can be the same mechanisms that provide the corresponding motions in conventional apparatus. Thus, the only requirement for modifying conventional "forming-and-filling" apparatus is to replace the standard sealing jaws with jaws constructed in accordance with this invention. Sealing jaws have a finite life and jaws constructed in accordance with this invention have a cost that is comparable to the cost for conventional jaws. Moreover, only minor, if any, modifications of the remaining apparatus are required and no special manufacturing procedures are required. Thus, there are no significant additional costs required for the manufacturing of these bags.

Embodiment 2

FIG. 7 depicts an alternative embodiment of a bag that also incorporates the features of this invention. More particularly the bag is easy to open and can easily be reclosed. The elements necessary for opening and reclosing the bag are formed integrally of the bag material without requiring any significant additional material and without requiring any significant modification to existing manufacturing apparatus or procedures. As shown in FIG. 7, this bag 90 includes a body 91 of a heat sealable, treated cellophane material or like material. The bag 90 is heat sealed along a vertically ribbed top seal 92 and a bottom seal 93. The longitudinal seal is not shown. As the top seal 92 of a filled bag and bottom seal 93 of a next bag are formed, pull tabs 94 are cut from the bottom seal 93 and left as an integral part of the top seal 92. This operation leaves an opening 95 in the bottom seal 93 that constitutes one reclosure element. There is also depicted in FIG. 7 a slit 96 above the opening 95 which, as will be described later, also can serve as a reclosure element.

FIG. 8 depicts how this bag is easily opened. More specifically the tab portion 94 is easily separated into separate tabs 97 and 100 because they are not sealed. Thus the user separates the tabs 97 and 100, grabs them in his two hands, and then breaks the seal 92 by pulling the tabs 97 and 100 apart. This exposes the contents as shown in FIG. 8.

Reclosure of the bag after the contents have been partially removed is shown in FIG. 9. More particularly, the top seal 92 of the bag 91 is folded toward the bottom seal 93. The tab 94 can be inserted through the opening 95, whereby the bottom seal 93 captures the tab 94. Alternatively, the tab 94 can be inserted through the slit 96, if that is included, to provide a more positive capture of tab 94.

FIG. 10 depicts sealing jaws 101 and 102 for constructing a bag as shown in FIG. 7 with both the openings 95 and 96. Using the same convention to designate corresponding elements that was used in FIG. 6, the jaws comprise two sets of sealing faces. A first set comprises sealing faces 103A and 103B; a second set comprises faces 104A and 104B. Both faces use vertical or striated face designs. When the jaws 101 and 102 are pressed together, they form large, sealed areas in the web being processed that correspond to the top and bottom seals 92 and 93. In this particular example, the sealing faces include ribs that project about 2 millimeters from the base reference of the seal area.

The heated sealing areas 103A and 104A and areas 103B and 104B are separated, respectively, by a bead 105A and recess 105B that traverse the faces of the jaws 101 and 102 respectively. They are centrally disposed in the vertical direction of the jaws 101 and 102. In a horizontal direction, they each conform to the outline of the top of the body 91 and tabs 94 in FIG. 7.

More particularly, the bead 105A is formed with a first portion 106A that extends from one side of the jaw 101 toward the center and a second portion 107A that extends from the other side of the jaw 101 toward the center. At the central portion, however, the bead is displaced to form the tab 94 and cutout 95. A linear bead portion 110A, that forms the top of the tab 94, is offset and parallel to a line through bead portions 106A and 107A. A generally "S"-shaped bead portion 111A interconnects the bead portions 106A and 110A while a "reversed-S" bead portion 112A interconnects the bead portions 107A and 110A. The groove 105B has a corresponding configuration.

The bead 105A and recess 105B then constitute a cutting means for simultaneously separating adjacent bags and forming the outline of tabs in the upper seal 92 and the hole 95 in the lower seal 93.

In the jaw 101 an area 113A, defined by the bead portions 110A, 111A, and 112A and an imaginary extension of the bead portions 106A and 107A is either recessed or filled with a heat insulating material. A corresponding area 113B is formed in jaw 102. This area is sufficiently insulated so that it does not heat and seal the corresponding area of the bag. This provides the unsealed tabs 97 and 100 shown in FIGS. 7 and 8.

The slit 96 shown in FIG. 7 can also be formed with the heat sealing jaws 101 and 102. More particularly, a bead 114A is formed across a central portion of the surface 104A. It is parallel to and essentially laterally coextensive with the bead portion 110A. A corresponding recess 114B is formed in the face 104B in the jaw 102.

As will be apparent from FIG. 10, the jaws 101 and 102 contain no internally moving parts. They merely need to be moved in and out of contact with the bag material. Thus, these jaws can easily be substituted for existing jaws for making conventional bags without any significant modifications to the manufacturing apparatus.

Embodiment 3

Still another embodiment of this invention is shown in FIG. 11. In this embodiment, a bag 120 is formed by the process shown generally in FIG. 5 with a top seal 121 and a bottom seal 122. An unsealed portion 123 is centered at the top edge of the top seal 121 and notches 124 are formed at the edges of the seal 121. The seal 121 does have integrity when the notches are formed sufficiently above the pouch area. Reclosure is provided by a slit 125 that is formed and that extends only partially across the bottom seal 122. Stop holes 126 minimize any tendency of the slit 125 to tear beyond the stop holes 126.

This bag is opened when a user grabs the two unsealed portions of the bag 120 at the unsealed area 123 and breaks the seal. When the user wishes to reclose the bag, he flattens the top seal 121 and folds the bag over and pushes the sealed portion 121 through the slit 125. The notches 124 then are captured in the bottom seal 122 as the seal 121 passes through the slit 125. This positively closes the bag 120 and prevents its inadvertent reopening.

FIG. 12 depicts two heat sealing jaws 127 and 130 that form the bag shown in FIG. 11. The jaw 127 contains a horizontal centrally disposed slot or recess 131A with a corresponding slot or recess 131B being formed in jaw 130. The recess 131A houses a cutting blade 132 that is forced into the slot 131B to separate adjacent bags. The slots 131A and 131B additionally divide two heat sealing faces. Heat sealing faces 133 and 133B coact to form the bottom seal 122 of the bag whereas faces 134A and 134B define the top seal 121 of a bag.

The slit 125 and stop holes 126 shown in FIG. 11 are formed by a rib 135A in the jaw 127 and a corresponding recess 135B in the face of the sealing surface 133B. The lower heat sealing faces 134A and 134B contain semicircular, recessed or heat insulated areas 136A and 136B that define the unsealed portion 123 in the top seal 124. There are also shown in FIG. 12 notch-forming elements 137A and 137B. Again, the unsealed area 123, seals 121 and 122, notches 124, and slit 125 are all formed simultaneously as the heat jaws 127 and 130 are brought together. Moreover, it will be apparent that these jaws also can be easily substituted for conventional jaws in existing apparatus. Thus, this embodiment also attains the objectives of this invention because no additional elements are added to the bag and because the manufacturing apparatus can be easily modified at no significant expense.

Embodiment 4

Figure 13:
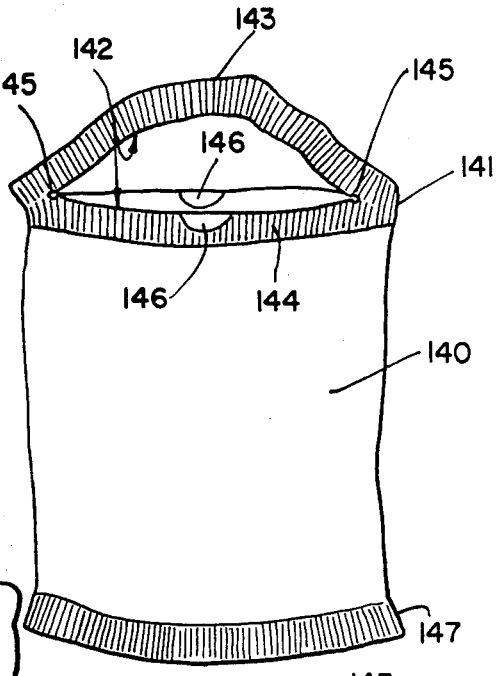
FIG. 13 is a perspective view of a fourth embodiment of a bag constructed in accordance with this invention.
Figure 14:
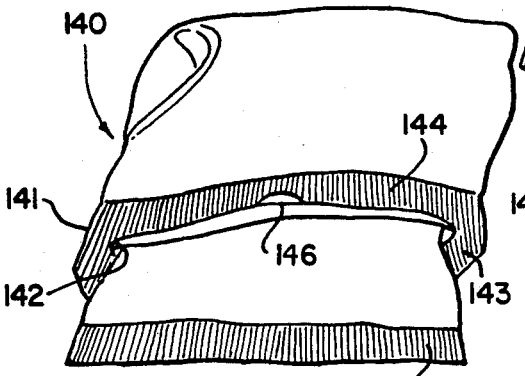
FIG. 14 is a perspective view that illustrates the ease with which the bag in FIG. 13 is closed.
Figure 15:
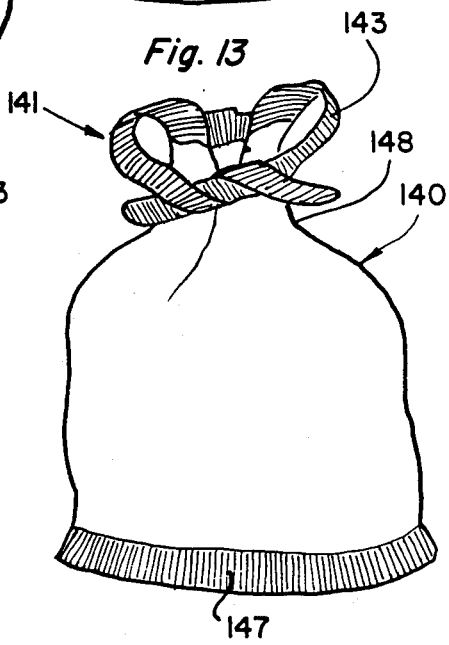
FIG. 15 is a perspective view that also illustrates the ease with which the bag in FIG. 13 is closed.

Still another variation of a bag 140 in which all of the reclosure means are provided in the top seal is shown in FIG. 13. More specifically, a top seal 141 includes a perforation or knife cut 142 that partially traverses the bag and, in the top seal 141, thereby to define a handle 143 and a sealed portion 144. The cut or perforation 142 terminates at either end with a stop hole 145 thereby to prevent complete tearing of the handle 143 from the bag 140. When the handle is separated, unsealed portions 146 in the lower portion 144 of the seal 141 provide tabs for easily opening the bag 140. FIGS. 14 and 15 depict two ways in which the bag can be reclosed. In FIG. 14 the top of the bag is folded over and a bottom seal 147 is pushed, in its entirety, through the opening between the handle 143 and the top seal 144. In FIG. 15 the handle 143 is wrapped around the gathered neck portion 148 of the bag 140, thereby to provide a locking or reclosure mechanism.

FIG. 16 depicts jaws 150 and 151 for forming the bag shown in FIG. 13. Jaw 150 includes three heat sealing faces 152A, 153A, and 154A that are separated by recesses 155A and 156A. The recess 155A contains a cutting knife 160 so that the sealing faces 152A and 152B coact to form the bottom seal 147. Sealing faces 153A and 153B coact to form the handle 143, while heat sealing areas 154A and 154B form the sealed portion 174 Recesses 156A and 156B extend only partially across the faces of the jaws 150 and 151. Punches 161A and recesses 161B form the stop holes 145 shown in FIG. 13. Surfaces 162A bridge the heat sealing surfaces 153A and 154A outside the punches 161A. Corresponding surfaces 162B are formed on the jaws 151 to bridge surfaces 153B and 154B. The unsealed portion 146 of the bag is formed by recesses or insets 163A and 163B, formed in the heat sealing surfaces 154A and 154B contiguous the recesses 156A and 156B, respectively.

Embodiment 5

Figure 17:
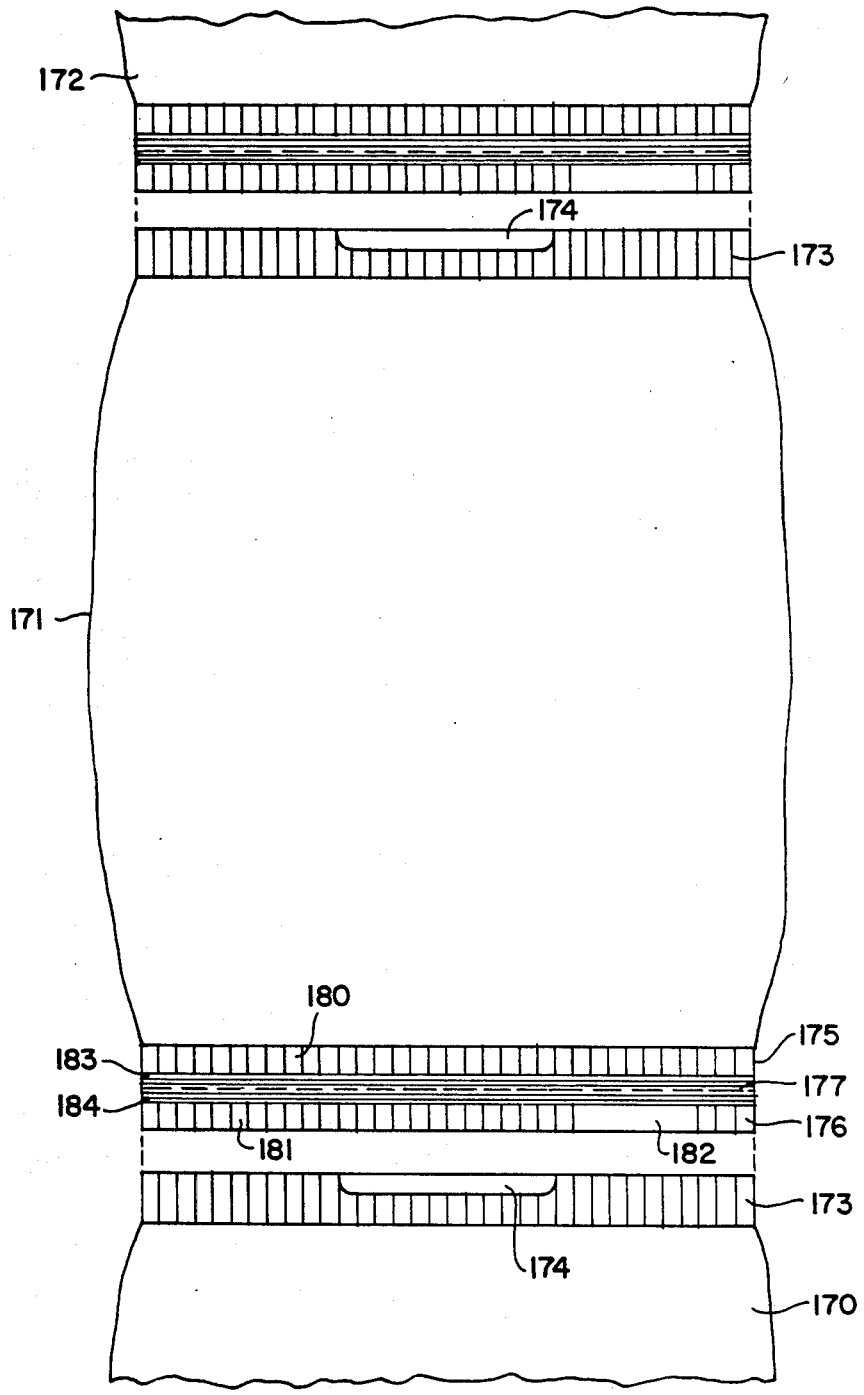
FIG. 17 is a perspective view of a fifth embodiment of bag constructed in accordance with this invention.

FIG. 17 depicts a succession of bags 170, 171, and 172. Referring to bag 171, a heat sealed portion 173 extends across the top of the bag. It contains unsealed portion 174 that allows a person to open the bag readily in much the same way as the other embodiments.

The bottom of the bag comprises a bottom seal portion 175 and a reclosure tie portion 176. The reclosure tie is torn along a perforation line 177 thereby to provide a removable reclosure tie analogous to that shown in FIG. 1. Specifically the bottom seal comprises a vertically corrugated portion 180 that traverses the bag 171 and seals together the opposite walls 171*a* and 171*b* of the bag. The reclosure tie 176 comprises a similar vertically corrugated section 181 that extends across the bag except at a portion 182 that is not sealed. That corrugated section fuses or bonds together and seals opposite wall segments 181*a* and 181*b* which constitute extensions of the bag walls 171*a* and 171*b*. Unlike the bag shown at FIG. 1, the bag 172 additionally comprises melted seal ridges 183 and 184 that extend across the bag contiguous the perforation line 177. In the illustrated bag, there are two ridges 183 above line 177 and two ridges 184 below that line. The structure of these melted ridges 183 and 184 will be more evident by viewing the heat sealing jaw shown in FIGS. 18 and 18A.

Figure 18B:
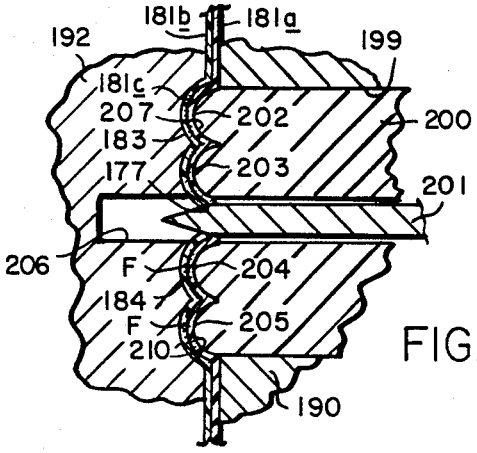
FIG. 18B is a sectional view showing the operation of FIG. 18 jaws.
Figure 18:
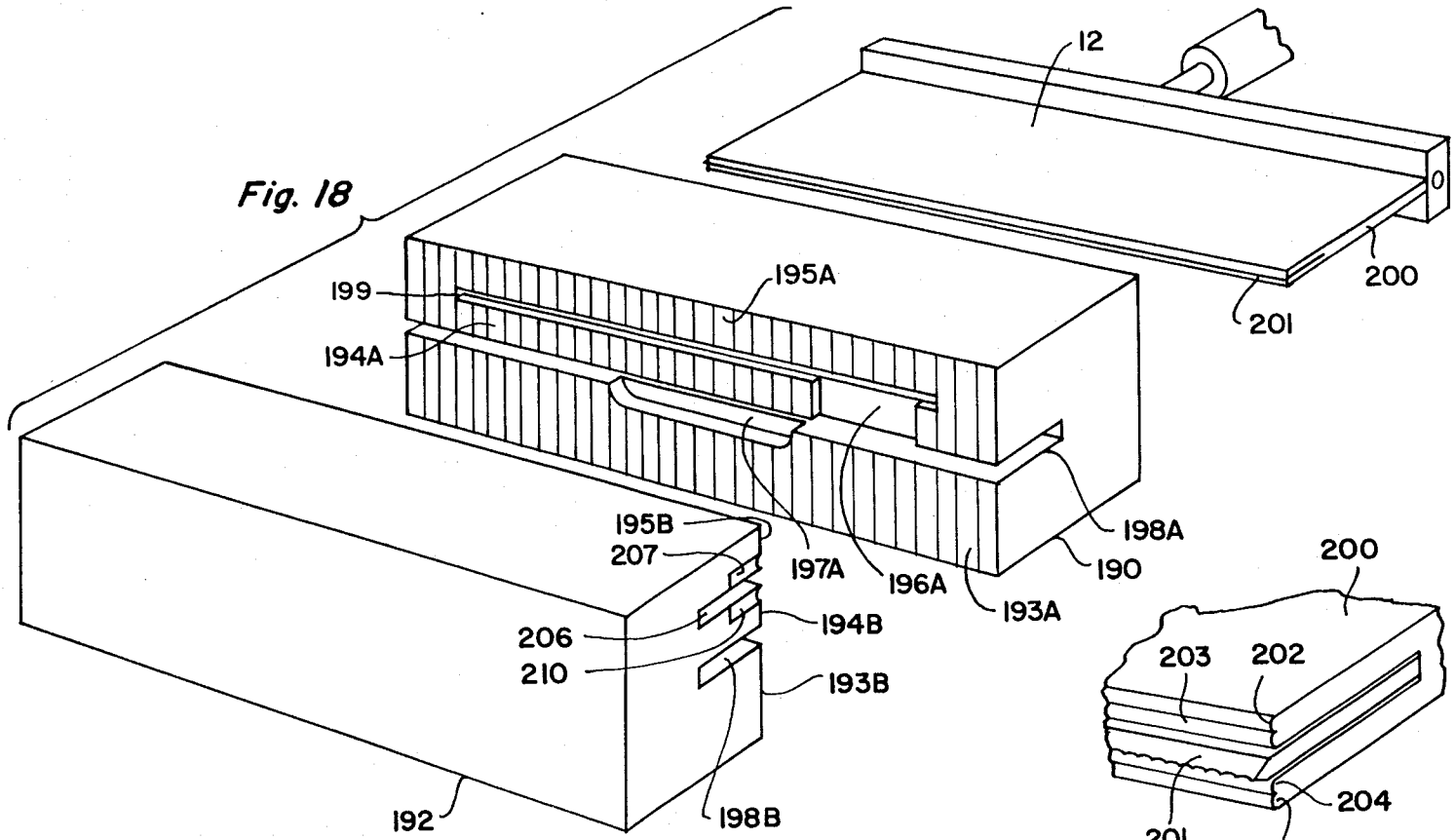
FIG. 18 depicts the heat sealing jaws for constructing the bag shown in FIG6. 17.
Figure 18A:
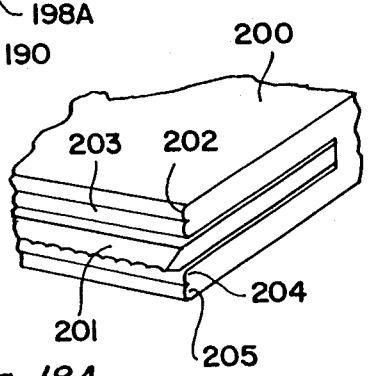
FIG. 18A is a scrap view of a portion of FIG. 18.

Referring to FIGS. 18 and 18A, jaw 190 contains three heat sealing areas 193A, 194A, and 195A that coact with corresponding faces 193B, 194B and 195B on the jaw 192. In conjunction with the recessed areas 196A and 197A they form the bag with the configuration shown in FIG. 17. A slot 198A is provided in heat sealing jaw 190 to receive a parting blade (not shown) that extends into a corresponding slot 198B in jaw 192 to separate adjacent bags, such as bag 170 from bag 171 in FIG. 17. A second blade 200 forms the perforation line 177 in FIG. 17. Blade 200 is received in a slot 199 in jaw 190.

Referring specifically to FIG. 18A, a perforation blade 201 extends from blade 200 to form the perforation line. On opposite sides of blade 201 are formed outwardly rounded dies that produce the melted ridges 183 and 184. In this particular embodiment there are two heated rounded dies 202 and 203 above the perforation blade 201 and two heated rounded dies 204 and 205 below the blade 201.

The jaw 192 comprises a slot 206 that receives the perforation blade 201 and inwardly rounded anvils 207 and 210 that receive the ridge dies 202 through 205 as seen in FIG. 18.

Thus, as best seen in FIG. 18B, as the bag is formed and the blade 200 is extended, the perforation blade 201 forms the perforated line 177, while the dies 200 through 205, that are heated, drive the opposite bag wall extensions 181*a* and 181*b* above and below the perforation line into the anvils 207 and 210 so that they are brought into conformance with these anvils and with each other and are fused or bonded together at F as shown in FIG. 18B to form the two pairs of horizontally extending melted ridges 183 and 184 that bracket the perforation line 177. The recesses 196A and 197A in jaw 190, of course, form the unsealed areas 174 and 182.

These melt ridges provide several advantages. When a person begins to tear away the reclosure tie, it is possible for the perforation to begin along the perforation line 177. However, the user rarely pulls the reclosure tie so all forces are directed along the perforation line 177. There is usually some vertical force applied with respect to the perforation line as shown in FIG. 18. To the extent that removal of the reclosure would tend to direct the tear in a vertical direction thereby either to break the bottom seal portion 180 or rip the reclosure tie 181, the tearing motion is stopped by the melted ridges 183 and 184 and redirected along the perforation line 177

As a second advantage, removal of the reclosure tie will form nicks that constitute partial tears in the reclosure tie. When the user then reseals the bag, the stress imparted to the reclosure tie can cause these irregularities or nicks, which constitute the beginnings of tears, to stress beyond the tensile strength and thereby propogate one of the nicks as a tear through the remainder of the seal. The melted ridges in the reclosure tie obviate any tendency of a nick to propagate as a tear, because any such tear would have to transverse the thick cross section of the melted ridges.

Finally, the melt ridges constitute a heat-fused band of packaging material that is raised to a temperature below the melting point but above its sealing point. This is a stronger seal and therefore improves the bottom seal of the bag shown in FIG. 17. However, the existence of the melt ridges across the width of the reclosure tie does not adversely affect the ability of the user to separate the reclosure tie in the unsealed area 182.

From the foregoing description of the bag and heat sealing jaws in FIGS. 17, 18 and 18A, it will be apparent that this same concept of transverse melt ridges can be applied to any of the bags disclosed in this application.

In summary there are disclosed a number of embodiments of a bag that stores contents in a sealed pouch. This bag is easily opened and easily reclosed. In all the embodiments the reclosure mechanism is formed integrally with the bag and of the same material as the bag. Moreover, it is formed in the same operation by the same jaws or mechanism that forms the seals of the bag. In some of these embodiments the reclosure means is formed in only one of the seals; in other embodiments the reclosure means is formed in two of the seals or adjacent two of the seals. In any of these approaches the bag is constructed without the use of any more material than is currently utilized in the construction of most bags. All the embodiments are readily adapted to conventional "forming-and-filling" apparatus. Equipment modifications require only a set of replacement jaws that normally will not cost much more than the conventional set of jaws and which can be replaced at a time of normal jaw replacement.

From an examination of the bags and jaws that have been specifically disclosed, it will be apparent that there is a wide range of modifications and alterations that can be made to these specifically disclosed embodiments. These modifications and alterations can be made while attaining some or all of the objects and advantages of this invention. Therefore, it is the object of the appended claims to cover all such variations and modifications as come within the true spirit and scope of this invention.

What is claimed as new and desired to be secured by Letters Patent of the United States is:

1. In a bag formed to enclose contents in a sealed pouch between walls of the bag and constructed with at least two seals formed by the material of the bag, the seals enclosing the bag and sealing the contents within the bag, the improvement wherein A. the bag is formed as a flattened tube having a longitudinal seal and two end seals;

B. opening are provided at a selected end seal to facilitate breaking said selected end seal to gain access to the interior of the bag, said opening means comprising an unsealed portion formed in said selected seal for exposing separated bag wall portions adjacent to the seal thereby to facilitate gripping of the separated portions for breaking that seal;

C. reclosure means are formed integral with the bag at an end seal thereof for reclosing the open end of the bag after said selected end seal has been broken, said reclosure means comprising a pair of opposite walls which are integral extensions of said bag walls;

D. a perforated tear line is present at the boundary of said reclosure means and the adjacent end seal;

E. a transversly directed seal ridge is spaced generally parallel to said perforated tear line in said reclosure means, said ridge 1. being substantially continuous and coextensive with said perforated tear line, and
2. comprising conforming, fused-together portions of the opposite walls of said reclosure means.

2. The bag defined in claim 1 wherein said unsealed portion is formed in the seal at said reclosure tie and extends to said perforation line.

3. The bag defined in claim 1 wherein said unsealed portion is located at said selected seal and extends to an edge of said bag.

4. In a bag formed to enclose contents in a sealed pouch between walls of the bag and constructed with at least two seals formed by the material of the bag, the seals enclosing the bag and sealing the contents within the bag, the improvement wherein A. the bag is formed as a flattened tube having a longitudinal seal and two end seals;

B. means are provided at a selected end seal to facilitate breaking said selected end seal to gain access to the bag contents;

C. reclosure means are formed integral with the bag at an end seal thereof for reclosing the open end of the bag after said selected end seal has been broken, said reclosure means comprising a pair of opposite walls which are integral extensions of said bag walls;

D. a perforated tear line is present at the boundary of said reclosure means and the adjacent end seal;

E. a transversely directed seal ridge is spaced generally parallel to said perforated tear line in said reclosure means, said ridge (1) being substantially continuous and coextensive with said perforated tear line, and
(2) comprising conforming, fused-together portions of the opposite walls of said reclosure means; and F. means defining a loop-forming opening are present in said reclosure means.

* * * * *